US006095356A

United States Patent [19]

Rits

[11] Patent Number: 6,095,356

[45] Date of Patent: Aug. 1, 2000

[54] VENTED FLASK CAP FOR ABSORBING RADIOACTIVE GASES

[75] Inventor: Miriam Rits, Brookline, Mass.

[73] Assignee: Children's Medical Center Corp., Boston, Mass.

[21] Appl. No.: 09/266,164

[22] Filed: Mar. 10, 1999

[51] Int. Cl.[7] ..... C12M 1/24; B65D 51/16

[52] U.S. Cl. ..... 215/261; 215/308; 435/297.1; 422/101

[58] Field of Search ..... 215/261, 307, 215/308, 309, 310, 347, 348, 349, DIG. 3; 435/297.1, 297.5; 422/101, 102; 220/371, 372, 373

[56] References Cited

U.S. PATENT DOCUMENTS

| | | | |
|---|---|---|---|
| 3,326,401 | 6/1967 | De Long | 215/261 |
| 3,964,887 | 6/1976 | Hickey et al. | 55/267 |
| 4,127,397 | 11/1978 | O'Nan, Jr. et al. | 55/479 |
| 4,135,896 | 1/1979 | Parish et al. | 55/270 |
| 4,142,940 | 3/1979 | Modolell et al. | 195/139 |
| 4,271,973 | 6/1981 | Quagliaro et al. | 215/261 X |
| 4,646,947 | 3/1987 | Stull | 222/397 |
| 4,670,398 | 6/1987 | Song | 435/298 |
| 4,839,292 | 6/1989 | Cremonese | 435/313 |
| 4,863,051 | 9/1989 | Eibner et al. | 215/261 |
| 4,935,371 | 6/1990 | Rickloff | 435/296 |
| 4,980,132 | 12/1990 | Stinson et al. | 422/159 |
| 5,047,348 | 9/1991 | Stinson | 435/311 |
| 5,066,597 | 11/1991 | Stinson et al. | 435/311 |
| 5,352,414 | 10/1994 | Rothenberg | 422/101 |
| 5,358,872 | 10/1994 | Mussi et al. | 435/296 |
| 5,391,496 | 2/1995 | Kayal et al. | 435/286 |
| 5,523,236 | 6/1996 | Nuzzo | 215/261 X |
| 5,578,491 | 11/1996 | Kayal et al. | 435/288.1 |
| 5,693,537 | 12/1997 | Wilson et al. | 435/401 |
| 5,766,936 | 6/1998 | Kayal et al. | 435/297.1 |
| 5,792,427 | 8/1998 | Hugh et al. | 422/109 |

FOREIGN PATENT DOCUMENTS

| | | | |
|---|---|---|---|
| 337677 | 10/1989 | European Pat. Off. | 215/261 |
| 88/01605 | 3/1988 | WIPO | 215/261 |

*Primary Examiner*—Nathan J. Newhouse
*Attorney, Agent, or Firm*—Nutter, McClennen & Fish, LLP

[57] ABSTRACT

A vented flask cap having a body portion with proximal and distal ends with a generally cylindrical sidewall extending from the proximal end to the distal end of first and second support plates are formed at the proximal end of the body portion and having a plurality of apertures extending therethrough; a filter assembly is also provided which includes a first, lower membrane having a first porosity, a second, upper membrane having a second porosity and a radiation absorbing material disposed between the first and second membranes.

17 Claims, 2 Drawing Sheets

VENTED FLASK CAP FOR ABSORBING RADIOACTIVE GASES

CROSS REFERENCE TO RELATED APPLICATIONS

Not Applicable

STATEMENT REGARDING FEDERALLY SPONSORED RESEARCH

Not Applicable

FIELD OF THE INVENTION

The present invention relates to a vented cap and more particularly to a vented cap used for incubating radioactive items such as cell cultures and the like.

BACKGROUND OF THE INVENTION

In the course of biological and medical research, radioactive isotopes are frequently used for metabolic labeling of various cells in tissue cultures. For example, compounds containing the radioactive isotope $^{35}S$ can be added to a tissue culture to perform metabolic labeling of proteins. Most often, these cultures are incubated in containers such as hand-held flasks or vessels. During this incubation period, volatile radio-labeled gas compounds containing $^{35}S$ are produced in the flasks which can subsequently escape into the environment.

Typically, escape of radioactive gases is continuous during incubation but most prevalent when the tissue culture container is opened for any reason. Once released, these gases will quickly contaminate the surrounding environment of the incubator, including interior walls, floors, shelves, fans and other areas. Experimental procedures involving radioactive labeling present health hazards to laboratory personnel due to inhalation of the radioactive gases. Currently, it is both hazardous and time consuming to decontaminate the incubator using traditional techniques.

There is thus a need for safe, effective techniques and equipment for preventing the release of radioactive gases during radioactive labeling experiments. Current practices for dealing with radioactive emissions from incubating cells or other items are not effective or practical for laboratory personnel.

DETAILED DESCRIPTION OF THE DRAWINGS

The present invention provides a vented cap 10 which enables radioactive biologically contaminated materials to be incubated in a flask or vessel without a release into the environment of volatile radioactive materials, such as the radioactive isotope $^{35}S$.

Figure 1:
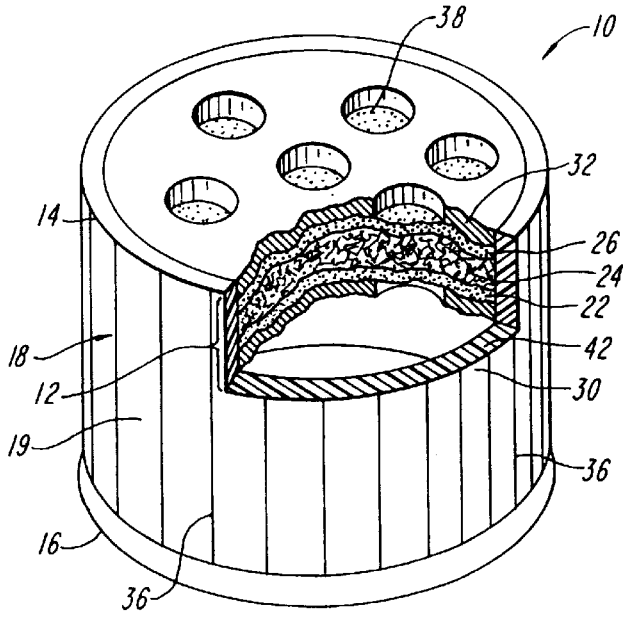
FIG. 1 is perspective view of a vented cap, partially cut-away, according to the present invention.
Figure 2:
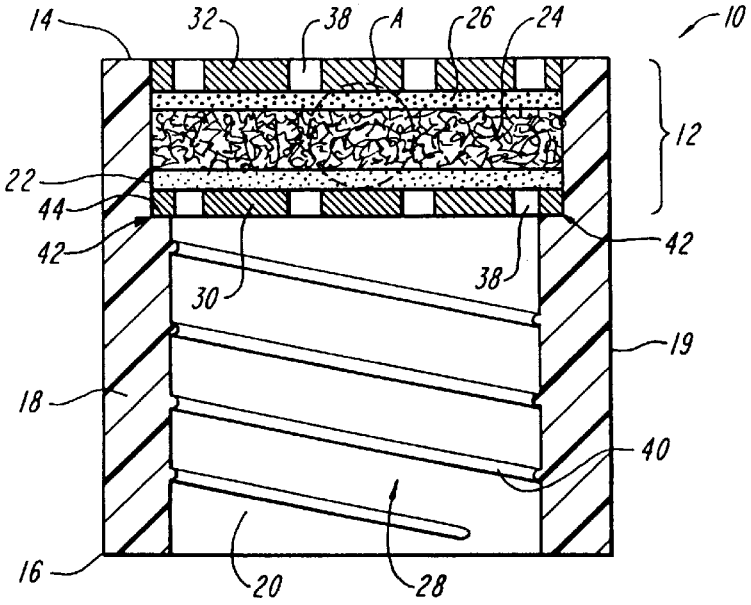
FIG. 2 is a side sectional view of the vented cap of FIG. 1.

Referring to FIGS. 1 and 2, the vented cap 10 of the present invention includes a filter assembly 12 which is operably disposed within the cap body so that gases produced in the flask or vessel pass through the filter assembly 12. The vented cap 10 as shown and described herein may be constructed of a rigid non-porous material such as a molded polymeric material, e.g., polyethylene, polypropylene and polyvinyl chloride.

As shown in FIG. 1, the vented cap 10 has a superior or top portion 14 and an inferior or bottom portion 16 with a generally cylindrical sidewall 18 extending between the top and bottom portions 14, 16. The generally cylindrical sidewall 18 has an outer surface 19 which may have a variety of surface features formed thereon to provide a secure gripping surface for the vented cap 10. In one embodiment, the surface feature is in the form of at least one ridge 36 which protrudes from the outer surface 19 of the sidewall 18. Each ridge 36 may be a continuous structure extending from the top portion 14 to the bottom portion 16 of the vented cap 10, or it may be present on the outer surface 19 of the vented cap 10 in discrete sections. Alternatively, the surface features may also take on the form of a series of indentations formed along the outer surface 19 of the sidewall 18.

Figure 5:
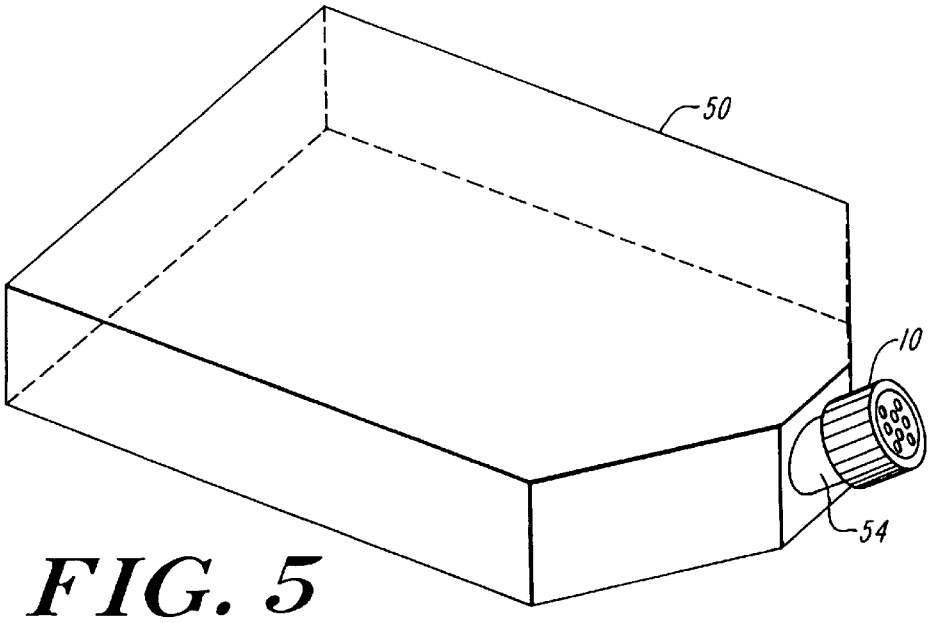
FIG. 5 is a perspective view of the vented cap of the present invention shown with a tissue culture flask.

Referring to FIGS. 2 and 5, the cap sidewall 18 also includes an inner surface 20 which defines a cavity 28 which may be mounted upon a portion of the tissue flask or vessel. In an exemplary embodiment, the inner surface 20 also has threads 40 formed thereon that are effective to threadably engage complementary threads (not shown) on the tissue culture flask or vessel as discussed below.

The inner surface 20 of the sidewall 18 further includes a mounting ledge or shoulder 42 effective to seat and secure the filter assembly 12 which is mounted within the vented cap 10. The mounting shoulder 42 may extend partially or entirely around the circumference of the inner surface 20 of the vented cap 10, either continuously or in discrete sections. The mounting shoulder 42 includes a proximally facing surface 44 which engages the filter assembly 12 to prevent the filter assembly from sliding downward in the vented cap 10. At the top portion of the cap, the filter assembly 12 is secured by an upper support plate 32 as discussed in more detail later herein.

Figure 3:
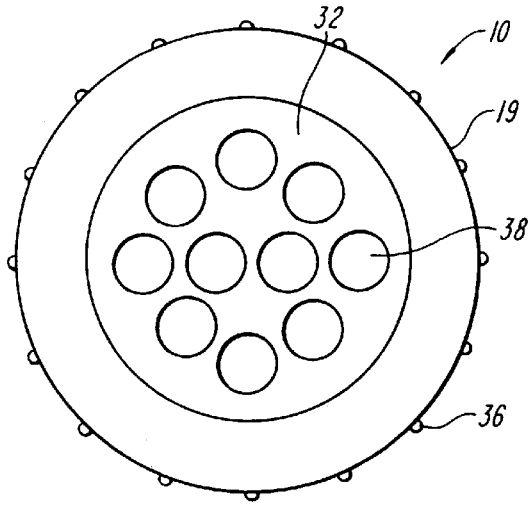
FIG. 3 is a top view of the vented cap of FIG. 1.
Figure 4:
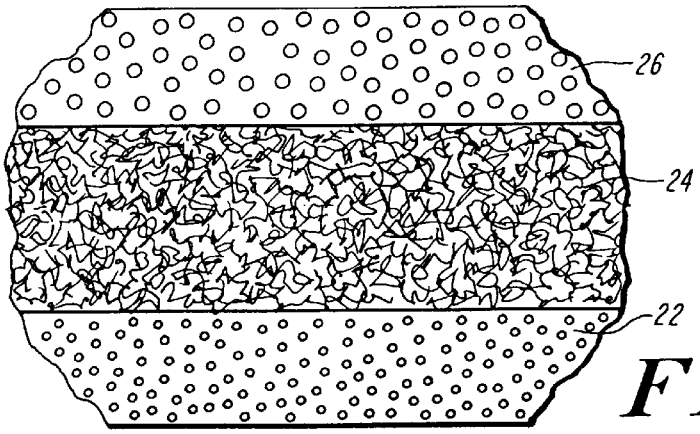
FIG. 4 is a detailed view of portion A of the filter assembly shown in FIG. 2.

Referring to FIGS. 2–4, the filter assembly 12 includes a first lower gas permeable membrane or layer 22 and an upper gas permeable membrane or layer 26. An absorbing intermediate material 24 is sandwiched between the lower and upper layers 22, 26. The upper layer 26 serves as a mechanical barrier to prevent unwanted release of the absorbing intermediate material 24. However, the upper layer 26 is constructed to still provide sufficient gas exchange in and out of the flask during use. In an exemplary embodiment, the lower and upper gas permeable membranes have differing porosities relative to one another such that the lower membrane is less porous than the upper membrane. Preferably, the lower gas permeable membrane 22 has a pore size in the range of about 0.1 to 0.3 microns and most preferably, about 0.2 microns. The upper gas permeable membrane 26 has a pore size in the range of about 0.3 microns up to about 1 mm. Additionally, the lower gas permeable membrane 22 preferably is constructed of material having hydrophobic properties to prevent the unwanted release of any fluids out of the flask or vessel.

In the present invention, the gas permeable membranes may be made from any suitable gas permeable material so long as the material provides adequate passage of gases such as oxygen and carbon dioxide into and out of the flask or vessel. Preferably, the first lower gas permeable membrane is made of a hydrophobic material having a porosity of approximately 60% to 85% such as polyvinylidene fluoride (PVDF) and polytetrafluoroethylene (PTFE). The second membrane or layer may be made of a variety of materials, such as perforated nylon, sufficient to serve as a mechanical barrier for the intermediate absorbing material yet still allow the exchange of gases therethrough.

As shown in FIG. 4, the intermediate material 24 is a radiation absorbent material such as activated charcoal, silver mesh or copper matrix which is disposed between the gas permeable membranes within the filter assembly 12. Preferably, the intermediate material 24 is a copper mesh of the type suitable for absorbing radioactive gases and other types of contaminating gases emitted in radioactive labeling and other experiments. In an exemplary embodiment, the copper matrix is packed into the filter assembly at a thickness in the range of about 1 to 3 mm. The amount of copper matrix is critical to ensure sufficient dwell time for substantially all radioactive contaminants to be absorbed during an experiment. Preferably, the amount of copper matrix used should be greater than the predicted amount of radioactive material to be absorbed.

As shown in FIGS. 1 and 2, the filter assembly 12 further includes a lower support plate 30 and an upper support plate 32 which together form a support structure for the gas permeable membranes and the radiation absorbing material. In an exemplary embodiment, the support plates 30, 32 each have a plurality of openings or apertures 38 formed therethrough. Each support plate has in the range of about 4 to 12 openings to promote sufficient gas exchange into and out of the flask or vessel. In an alternative embodiment, the upper support plate 32 may be substituted for the upper gas permeable layer 26 or alternatively the support plate 32 and upper layer 26 may be integrally formed as a single piece.

In an exemplary embodiment, when the vented cap 10 is finally assembled, the openings formed on the lower support plate 30 and the openings formed on upper support plate 32 aligned in a substantially vertical fashion within the vented cap 10. This alignment ensures that a reasonable amount of gas exchange is promoted via the openings between the support plates so that any tissue or culture material in the flask or vessel receives adequate aeration. Furthermore, this circulation of air is such that any radioactive compounds entrained within existing gases will be trapped within the absorbent material of the filter assembly 12. Accordingly, the gases exiting the container and passing into the environment will be free of radioactivity.

The size of the openings formed in the support plates may vary but should be sufficient for exposing an adequate amount of the gas permeable material and radiation absorbing material for absorbing contaminants produced within the flask or vessel during an experimental procedure. Preferably, the openings should cover between about 50% to 80% of the total surface area of each support plate such that a sufficient amount of filter surface area will be exposed to ensure that the majority of the radioactive gases emitted during an experiment will be absorbed.

In an exemplary embodiment, the support plates 30, 32 are constructed of a rigid nonporous material such as a molded polymeric material, e.g., polyethylene, polypropylene and polyvinyl chloride, metal screen or grid or nylon.

Referring to FIG. 5, the vented cap 10 of the present invention is constructed to be removably and replaceably attachable to a rigid or substantially rigid flask, vessel or container 50. Preferably, the flask 50 is constructed of a nonporous polymeric material. In an exemplary embodiment, the flask is constructed of a nonporous, rigid polymer such as acrylic, styrene acrylonitrile based polymers, as well as low density polyethylene or other suitable polymers or copolymers which effectively shield or contain low energy beta emitters or removable radioactive contamination. In preferred embodiments, it may be preferable to utilize transparent or translucent polymers, however, opaque polymers may also be used.

As shown in FIG. 5, the flask 50 includes a neck portion 54 which is integrally formed with the flask 50 and defines a generally cylindrical passageway through which the culture may be placed into the flask 50. In an exemplary embodiment, the neck portion 54 has threads (not shown) formed thereon to threadably engage the threads 40 formed on the inner surface 20 of the vented cap 10. Although only a threaded attachment construction is shown and described, it is understood that various alternative attachment constructions may be utilized, such as a snap-on or friction-fit type construction.

In accordance with the present invention the flask 50 may be of virtually any shape, however substantially square or rectangular containers are preferred. The size of the flask may vary depending upon the applications with which it is to be used. Typically, a rectangular rigid flask has a volume of between 25 ml. to 750 ml. so as to be useful in tissue culture experimental procedures.

Once the size of flask has been selected and the tissue cultures or materials to be incubated are placed within the flask 50, the vented cap 10 is screwed back onto the neck portion 54 to seal the flask 50. After the cultures or materials have been sufficiently incubated, it is intended that the entire vented cap 10 be discarded. Alternatively, simply the filter assembly may be discarded and the main cap body be retained after absorption of a predetermined amount of radioactive material. The cap body can then be reused with a new filter assembly.

Although the present invention has been described with respect to currently preferred embodiments, those having ordinary skill in the art may make modifications and variations to the invention without exceeding the scope of the invention. For example, the design of filters and the filtering material useful with the embodiments of the invention may be altered. Various filter materials can be used in lieu of copper, carbon or silver, including ceramic materials having absorbent materials incorporated into the porous channels in the ceramic matrix, or fibrous matrices, again incorporating absorbent materials.

In addition, changes may be made to the seating or mounting the filter assembly within the vented cap, again without exceeding the scope of the present invention. Furthermore, the vented cap and filter assembly may be modified to be adapted to other containers such as petri dishes in order to absorb any radioactive materials which may be produced in experiments where containers such as petri dishes are utilized.

What is claimed is:

1. A vented cap comprising:

a cap body having a top portion with at least one aperture extending therethrough and a generally cylindrical sidewall extending from the top portion, the sidewall having an outer surface and an inner surface; and a filter assembly disposed at the top portion of the cap body, the filter assembly including a first, lower gas permeable membrane, a second, upper gas permeable membrane and a radiation absorbing material disposed between the first and second gas permeable membranes.

2. The vented cap of claim 1, wherein the inner surface of the sidewall has a mounting shoulder formed thereon for securing the filter assembly within the vented cap.

3. The vented cap of claim 1, further comprising at least one rigid plate for supporting the filter assembly in the top portion of the cap, the at least one rigid plate having a plurality of apertures formed therein.

4. The vented cap of claim 1, wherein the radiation absorbing material is selected from the group consisting of copper, silver and carbon.

5. The vented cap of claim 1, wherein the inner surface of the sidewall has threads formed thereon.

6. The vented cap of claim 1, wherein the first and second gas permeable membranes have different porosities.

7. The vented cap of claim 6, wherein the first, lower gas permeable membrane has a pore size in the range of 0.1 to 0.3 microns.

8. The vented cap of claim 7, wherein the second, upper gas permeable membrane has a pore size in the range of about 0.3 microns to 1.0 millimeter.

9. The vented cap of claim 8, wherein the first, lower gas permeable membrane is hydrophobic.

10. The vented cap of claim 9, wherein the first gas permeable membrane is made of a material selected from the group consisting of polyvinylidene fluoride and polytetrafluoroethylene.

11. A vented flask cap comprising:

a body portion having proximal and distal ends with a generally cylindrical sidewall extending from the proximal end to the distal end, the sidewall having an outer surface and an inner surface with threads formed thereon effective to threadably engage a tissue culture vessel;

a first and second support plates formed at the proximal end of the body portion, the support plates having a plurality of apertures extending therethrough; and a filter assembly interposed between the support plates which includes a first, lower membrane having a first porosity, a second, upper membrane having a second porosity and a radiation absorbing material disposed between the first and second membranes.

12. The vented flask cap of claim 11, wherein the radiation absorbing material is a copper matrix.

13. The vented flask cap of claim 11, wherein the second support plate and the upper membrane are integrally formed.

14. The vented cap of claim 11, wherein the first lower permeable membrane is made of a material selected from the group consisting of polyvinylidene fluoride and polytetrafluoroethylene.

15. The vented flask cap of claim 11, wherein the first and second membranes have different porosities such that the second membrane is more porous than the first membrane.

16. The vented flask cap of claim 15, wherein the first porosity of the first membrane is in the range of 0.1 to 0.3 microns and the second porosity of the second membrane is in the range of 0.3 microns to 1 millimeter.

17. The vented flask cap of claim 16, wherein the first, lower membrane is hydrophobic to prevent escape of a fluid from the tissue culture flask and maintain sufficient gas exchange.

* * * * *